US005217577A

United States Patent [19]

Steiner

[11] Patent Number: 5,217,577

[45] Date of Patent: Jun. 8, 1993

[54] WIRE-LINK BELT

[75] Inventor: Karl Steiner, Herbrechtingen, Fed. Rep. of Germany

[73] Assignee: Thomas Josef Heimbach GmbH, Fed. Rep. of Germany

[21] Appl. No.: 746,670

[22] Filed: Aug. 19, 1991

[30] Foreign Application Priority Data

Aug. 18, 1990 [DE] Fed. Rep. of Germany ..... 4026196

[51] Int. Cl.[5] ..... D21F 1/10; D04H 3/02

[52] U.S. Cl. ..... 162/232; 34/243 R; 139/383 A; 162/902; 428/222; 428/232; 428/397

[58] Field of Search ..... 139/383 A; 162/232, 162/348, DIG. 1, 902; 428/114, 232, 222, 397; 34/243 R

[56] References Cited

U.S. PATENT DOCUMENTS 4,395,308 7/1983 Dawes ..... 162/232

FOREIGN PATENT DOCUMENTS 0018200 10/1980 European Pat. Off. .
0050374 4/1982 European Pat. Off. .
0080713 6/1983 European Pat. Off. .
0128496 6/1984 European Pat. Off. .
0116894 8/1984 European Pat. Off. .
0211471 2/1987 European Pat. Off. .
2419751 8/1978 Fed. Rep. of Germany .
3243512 7/1984 Fed. Rep. of Germany .
3402620 7/1984 Fed. Rep. of Germany .

*Primary Examiner*—Karen M. Hastings
*Attorney, Agent, or Firm*—Joseph W. Berenato, III

[57] ABSTRACT

A wire-link belt 1, 41 comprises a first and second, opposite belt side 32, 34; 61, 64, the first side supporting a moving length of material or a web of paper 33, 62, said wire-link belt further comprising a plurality of interlinking wire coils 2, 3, 4, 5; 42,43 consisting alternatingly of end arcs 16, 17, 18, 19; 49, 50 and coil-turn legs 10, 11, 12, 13, 14, 15; 45, 46, 47, 48 connecting them and coupled in hinging manner by means of slip-through wires. To reduce slippage between the moving length of material or web of paper 33, 62 and the wire-link belt 1, 41 on one hand and buckling or elongation of said length of material on the other hand, the support of the wire coils 2, 3, 4, 5; 42, 43 at the slip-through wires is such that the wire coils 2, 3, 4, 5; 42, 43 each hinge about axes offset relative to the center plane of the wire-link belt 1, 41 towards its first belt side 32, 61.

20 Claims, 2 Drawing Sheets

WIRE-LINK BELT

The invention concerns a wire-link belt in particular serving as a covering in a papermaking machine, and comprising a first belt side receiving a web to be advanced and a second and opposite belt side, the wire-link belt evincing a plurality of adjacent and interlinking wire turns consisting alternatingly of end arcs and coil-turn legs connecting said arcs, said coil-turns being coupled like hinges by means of slip-through wires.

Proposals already have been advanced to use such wire-link belts as coverings for papermaking machines and to guide a paper web thereby through the papermaking machine. A suitable wire-link belt for papermaking machines however was created first only with the invention of the German Offenlegungsschrift 24 19 751. Such wire-link belts are assembled from a plurality of wire coils mounted adjacent to one another in the direction of advance while extending transversely to this direction of advance and made of heat-setting plastic, the turns of a wire coil being inserted by their end arcs into the gaps between turns of the wire coil already affixed to a belt segment, the overlapping being implemented in such a way that a channel enclosed by the end arcs is created and is crossed by an inserted slip-through wire coupling the particular adjacent wire coils. In this manner an endless wire-link belt can be made which on account of the hinging motion of the particular adjacent wire coils is characterized by good adaptability.

The wire of a wire coil essentially follows a helical path, but the pitch inside a coil-turn can be highly variable. To achieve a smooth surface, the wire coils of most wire-link belts are flattened. Thereby straight, elongated coil-turn legs—which always link two end arcs—are achieved at the surfaces, i.e. the first and second belt sides of the wire-link belt. As a rule the particular adjacent wire coils overlap by their end arcs and thereby enclose the slip-through wire.

In deviation of the basic type known from the German Offenlegungsschrift 24 19 751, double wire coils also may be used in wire-link belts, for instance in the manner of the European patent document A 0 116 894. As regards the latter wire-link belts, the turns of two adjacent wire coils interlink helically in such a way that slip-through wires are no longer required there, merely now for connecting the double wire coils. As a result half the slip-through wires can be eliminated.

Wire-link belts of the most diverse kind are disclosed in the European patent document A 0 018 200. Wire-link belts for instance may be made in double layers, the connection between layers being performed by additional wire coils enclosing both. Again this document discusses wire coils each extending over three adjacent slip-through wires and for which every two adjacent wire coils overlap each time two slip-through wires. Moreover this document discloses the coupling of the particular adjacent wire coils with more than two slip-through wires.

The European patent documents A 0 128 436 and A 0 050 374 propose introducing filler materials in the cavities enclosed by the coil-turn legs for the purpose of reducing the air permeability. Another attempt to lower the air permeability of a wire-link belt consists in flattening the coil-turn legs at least at the side facing the paper web, that is, to make them wider than in the end-arc zone and thereby to narrow the gaps between the coil-turn legs (See German patent 32 43 512).

It is known moreover to provide such wire-link belts at least at the side facing the paper web with an additional layer for instance in the form of a bonded or pinned fiber web (German Offenlegungsschrift 24 19 751, FIG. 3), in the form of a fabric (European patent document B 0 080 713) or in the form of perforated foils (European patent document B 0 211 471). These additional layers are meant to provide a more uniform surface and additionally to lower the air permeability to a desired value.

The above stated wire-link belts in part are stressfully reversed, especially when used in papermaking machines, as they move over guide rollers or drying drums. At each reversal, the individual wire coils hinge about the cross-sectionally circular slip-through wires, the pivot axis being in the center axis of the slip-through wires. This entails a relative motion at the contact surfaces between paper web and wire-link belt and results in part in elongating or buckling the paper web. Such a phenomenon is undesired when making high-quality and dust-free paper webs and in the extreme may cause damage to the web especially when it is being guided around said guide rollers.

To keep low the above effect, the wire-link belts are made as thin as possible and this can be achieved for instance using flat wires for the wire coils (see German patent 34 02 620). However there are limits on how much to reduce the thickness of the wirelink belts, in particular regarding mechanical strength. Accordingly relative motion at and between the contact surfaces of the paper web and the first belt side of the wire-link belt are unavoidable.

The object of the invention is to so design a wire-link belt of the initially cited kind that slippage between the length of material to be moved, in particular a paper web, and the wire-link belt as well as its buckling or elongation shall be reduced without having to particularly take into account the thickness of the wire-link belt.

In the basic concept of the invention, this problem is solved by designing the support for the wire coils on the slip-through wires in such a way that the wire coils always pivot about hinge shafts offset from the center plane of the wire-link belt toward its first belt side. Because of the offset of the invention of the hinge axes toward the contact area between the length to be moved and the wire-link belt, the relative motion between the wire-link belt and the length of material will be decreased when the wire coils are being pivoted, and the more so the less the distance between the hinge axes and the contact surface. In this manner buckling or elongations as well as roughing the length of material are avoided extensively or entirely. No particular attention need then be paid to the thickness of the wire-link belt, that is, in this regard it can be designed optimally in relation to the particular requirements.

The basic concept of the invention can be embodied in a number of different ways. In one applicable embodiment, the slip-through wires each comprise two rest edges which are longitudinally parallel and against which rest the coil-turn legs forming the first flat side, free spaces being present everywhere between the slip-through wire, the end arc and the coil-turn legs forming the second belt side, said free spaces allowing pivoting the wire coils about one of the rest edges. In this embodiment therefore the slip-through wires abut by two rest edges the coil-turn legs forming the first belt side. When the wire-link belt is reversed, the adjacent wire-link belts pivot each about the rest edge near the end arcs. The rest edges being substantially nearer the first flat side than the center axes of the slip-through wires, substantial lowering of the relative motion, between the length of material to be conveyed and the first belt side, ensues.

Preferably the slip-through wires shall comprise a surface parallel to the lower side of the adjacent coil-turn legs to assure good support with straight-motion of the wire-link belt. The cross-section of the slip-through wires should taper toward coil-turn legs forming the second belt side so that the pivoting motion about the rest edges shall be little hampered or not at all. Additional free spaces can be secured in that the end arcs curve inside in such a way that a free space increasing from the rest edge near the end arcs toward the coil-turn legs forming the second belt side shall be present. Lastly, the coil-turn legs forming the inside of the second belt side and the adjacent zone of the slip-through wires preferably are so matched to each that the slip-through wires shall abut these coil-turn legs when the wire coils are pivoted toward each other, except for play present in most cases. As a result, optimal guidance of the wire coils relative to the slip-through wires is assured during the pivoting motion.

The basic concept of the invention also can be embodied in such a way that the slip-through wires, and the transition zones from the coil-turn legs forming the second belt side to the end arcs, rest against each other on support arcs of which the circle-origins are located on that side of the central plane of the wire-like belt which is away from the support arcs and in that free spaces are present between all the slip-through wires, end arcs and coil-turn legs forming the first belt side to permit pivoting the wire coils relative to the slip-through wires by slippage on the support arcs about the origins. In this embodiment mode the above stated transition zones and the slip-through wires form support arcs in the form of a split bearing of which the radii project beyond the central axis of the slip-through wires toward the first belt side. In this manner the pivot axis coinciding with the origins is near the first belt side and after the support arcs have been formed can even be placed in the plane of the first belt side. In this case practically no relative motion takes place during reversal of the wire-link belt between the first belt side and the length of material to be moved. The free spaces ensure that the pivoting motion on the support arcs shall not be hampered within a desired pivot angle.

Appropriately the slip-through wires and the wire coils abut by means of complementary support arcs whereby at least linear support is provided by the mutually matched path of the contact between the slip-through wires and the transition zone between end arcs and coil-turn legs.

To create sufficient free space to pivot the wire coils, the slip-through wires shall cross-sectionally taper toward the coil-turn legs forming the first belt side. This can be implemented on one hand in that the side of the slip-through wires adjacent to the first belt side comprises a convex abutting arc, the radii of the support and rest arcs where called for being equal. In that case the cross-section will be oval or lenticular. On the other hand the sides of the slip-through wires adjacent to the first belt side may evince a triangular cross-section forming a rest edge.

Moreover all conventional types of wire-link belts can be manufactured in the wire-link belt of the invention. Therefore the invention incurs no restriction regarding the cross-sections of the wires of the wire coils, that is, flat wires can be used, and further wire shapes such as disclosed in the German patent 32 43 512 and European patent document A 0 211 471. In principle embodiments with several layers also are applicable, similar to those discussed in the European patent document A 0 018 200. Preferably heat-setting plastics such as polyamides or polyesters are applicable as the material for the wire coils and slip-through wires.

Again the wire-link belt of the invention also may be provided with a covering in the form of a fiber web, fabric or foil (German Offenlegungsschrift 24 19 751; European patent documents A 0 080 713 and A 0 211 471). If required, filler material furthermore may be placed in the yet free spaces of the wire-link belt, for instance in the form of foams, textile filaments or shaped wires.

BRIEF DESCRIPTION OF THE DRAWINGS

The invention is elucidated by means of embodiments shown in the drawing.

DETAILED DESCRIPTION

Figure 1:
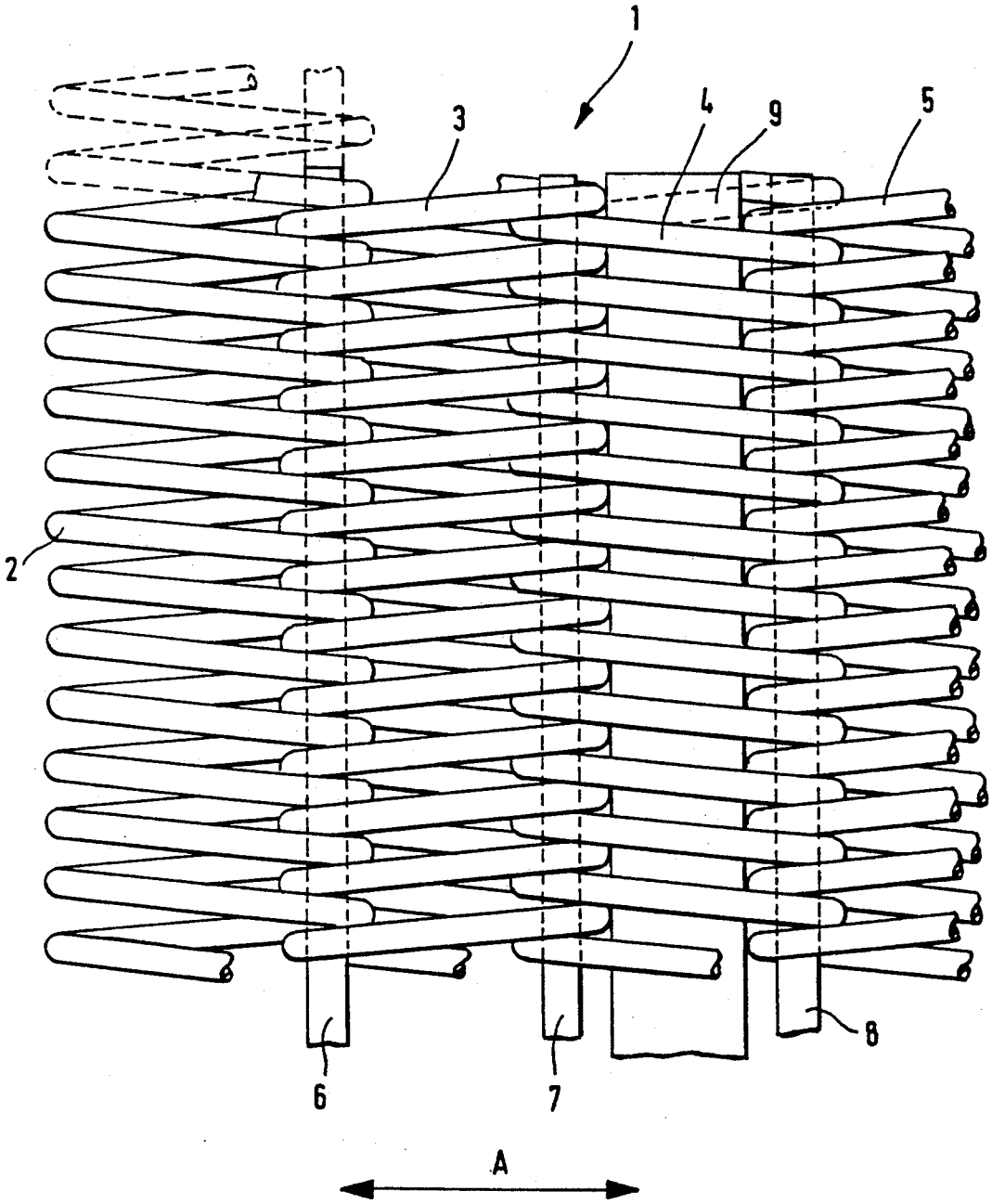
FIG. 1 is a topview of a wire-link belt of the invention.

The cutaway wire-link belt 1 shown in FIG. 1 extends longitudinally in the direction of a double arrow A which is also that in which it revolves in a machine, for instance a papermaking machine. In this direction it is endless. Its transverse width is specifically matched to the particular requirements.

The wire-link belt 1 comprises a plurality of axially transverse wire coils 2, 3, 4, 5 mounted adjacent to one another in the longitudinal direction A, and alternatingly one wire coil 2, 4 each is right-handed and one wire coil 3, 5 each is left-handed. Every two adjacent wire coils 2, 3, 4, 5 so interlace by their coil-turns in their gaps that they are overlapping and in each case form a transverse channel. Slip-through wires 6, 7, 8 are inserted into the channels and all slip-through wires 6, 7, 8 extend across the whole width of the wire-link belt 1. The slip-through wires 6, 7, 8 practically form hinge joints between every two adjacent wire coils 2, 3, 4, 5.

A cover strip 9 is inserted into the wire coil 4, namely in the channel enclosed by the coil-turns of this wire coil 4. Thereby the permeability to air transversely to the plane of the wire-link belt 1 is lowered.

Figure 2:
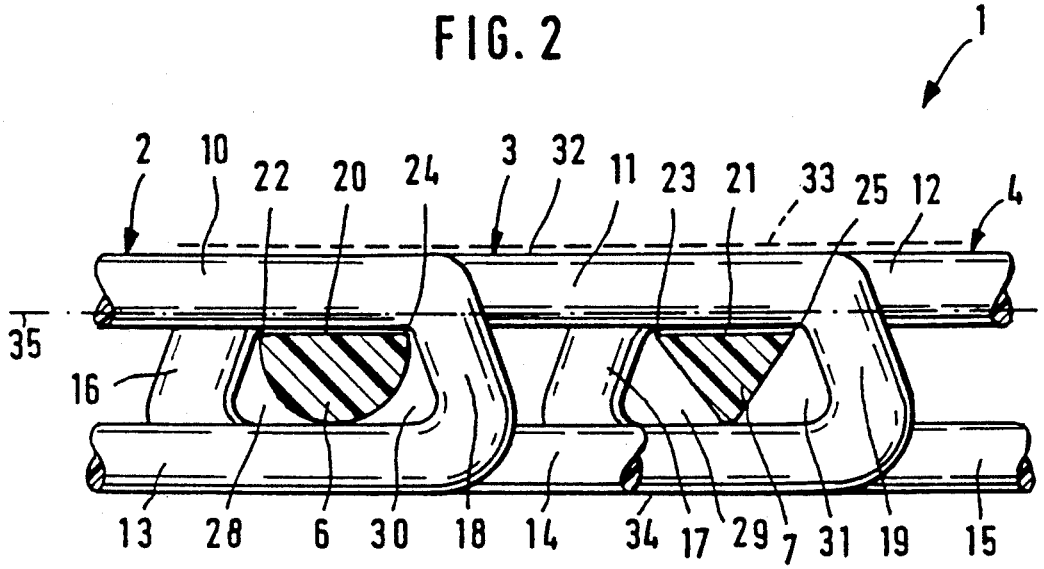
FIG. 2 is a partial sideview of the wire-link belt of FIG. 1.

FIG. 2 is a cutaway sideview on an enlarged scale of the wirelink belt 1 with the wire coils 2, 3, 4 and the slip-through wires 6, 7. The turns of the wire coils 2, 3, 4 each consist of straight, elongated top-side coil-turn legs 10, 11, 2 and also of straight, elongated bottom side coil-turn legs 13, 14, 15, the ends of the coil-turn legs 10, 11, 12, 13, 14, 15 being alternatingly connected by left-side and right-side end arcs 16, 17, 18, 19. As shown by FIG. 1, the sequence of the wire coil 2 as seen from below to top is first a bottom-side coil-turn leg 14, a left-side end arc 16, a top-side coil-turn leg 11 and a right-side end arc 19. The coil-turn legs 10, 13 and the end arc 18 belong to the wire coil 2, whereas the end arc 17 and the coil-turn legs 12, 15 are part of the wire coil 3.

Unlike the state of the art, the end arcs of the invention 16, 17, 18, 19 are not semi-circular, even though this also would be possible for the wire-link belt 1 shown herein. They always are slanting down toward the bottom-side coil-turn legs 13, 14, 15, pointing outward so that the bottom-side coil-turn legs 13, 14, 15 are commensurately longer than the top-side coil-turn legs 10, 11, 12.

The cross-section of the slip-through wires 6, 7 is not circular as in the state of the art. Instead each slip-through wire 6, 7 comprises a plane top-side 20, 21 which sideways are always bounded by a left-side rest edge 22, 23 and by a right-side rest edge 24, 25. The rest edges 22, 23, 24, 25 are parallel over the entire length of the slip-through wires 6, 7.

The cross-sections of the slip-through wires 6, 7 taper downward, once into a semi-circle (slip-through wire 6) and once into a triangle (slip-through wire 7). Because of this design of the slip-through wires 6, 7, and further the design of the end arcs 16, 17, 18, 19, essentially triangular, downward flaring left-side free spaces 28, 29 and right-side free spaces 30, 31 arise between said end arcs and the slip-through wires 6,7—obviously only one shape of slip-through wire is used in a specific wire-link band.

The top-side coil-turn legs 10, 11, 12 form a first belt side 32 supporting for instance a paper web 33 shown in dashed lines. The bottom-side coil-turn legs 13, 14, 15 define a second belt side 34.

When the wire-link belt 1 is guided around a drying drum in the drying part of a papermaking machine while in contact with the paper web 33 and along the heating roll, the first belt side 32 is bent concavely. The wire coils 2, 3, 4 then pivot about the slipthrough wires 6, 7, the right-hand end arcs 16, 17 pivoting about the right-hand rest edges 24, 25 and the left-hand end arcs 16, 17 pivoting about the left-hand rest edges 22, 23. This pivoting motion is unhampered because of the free spaces 28, 29, 30, 31.

The pivoting motion is correspondingly inverted when the wire-link belt 1 moves by its second belt side 34 over a guiding roll. In this case the first belt side 32 will be bent convexly and consequently the wire coils 2, 3, 4 pivot over the rest edges far from the end arcs, ie the right-hand rest arcs 18, 19 pivot over the left-hand rest edges 22, 23 and the left-hand end arcs 16, 17 pivot over the right-hand rest edges 24, 25.

In both instances the pivoting motion of the plurality of wire coils 2 takes place in a neutral plane 35 indicated by dot-dash lines and extending approximately near the lower side of the topside coil-turn legs 10, 11, 12. As regards the known wire-link belts with round slip-through wires, this neutral plane is located in the central plane of the wire-link belt 1 which is crossed by the axes of the slip-through wires. As regards the wire-link belt 1 of FIGS. 1 and 2, the neutral plane 35 is closer to the paper web 33, that is, the distance between the paper web 33 and the neutral plane 35 is substantially less. Accordingly the relative motion between the paper web 33 and the first belt side 32 is less when the wire-link belt 1 reverses. As a result the paper web 16 is less stressed, ie, it is less buckled or elongated, and furthermore the roughening of the contact surface with the first belt side 15 is lowered.

Figure 3:
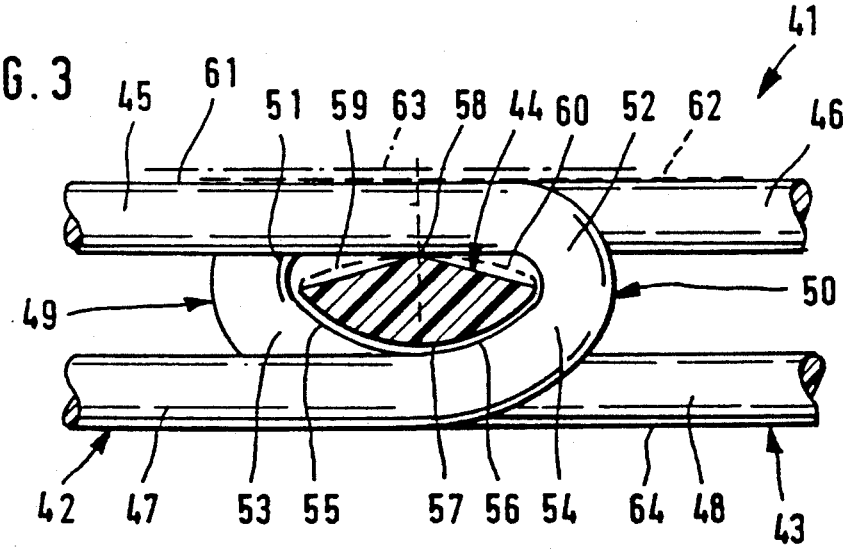
FIG. 3 is a partial sideview of another wire-link belt.

FIG. 3 shows a further wire-link belt 41 and is restricted to an enlarged sideview of the coupling zone of two adjacent wire coils 42, 43. The wire-link belt 41 in its basic design is the same as the wire-link belt 1 of FIGS. 1 and 2, however the shape of the wire coils 42, 43, and that of the slip-through wires coupling the wire coils 42, 43 and of which only the slip-through wire 44 is shown, is different.

Again the turns of the wire coils 42, 43 each consist of straight, elongated top-side coil-turn legs 45, 46 and also of straight, elongated bottom-side coil-turn legs 47, 48, the ends being alternatingly connected to each other by left-side and rightside end arcs 49, 50. In the present case the left-side end arc 49 is part of the coil-turn legs 46, 48 of the wire coil 43 and the right-side end arc 50 is part of the coil-turn legs 45, 47 of the wire coil 42.

As seen from top to bottom, the end arcs 49, 50 initially evince a sharp downward bend 51, 52 and then become quarter circles 53, 54 tangentially terminating into the adjoining, bottom-side coil-turn leg 47, 48. The quarter-circles 53, 54 on the inside form support arcs 55, 56 for the slip-through wire 44.

The slip-through wire 44 is symetrical relative to the vertical plane and is bounded at the bottom side by an arcuate support arc 57. Essentially the radius of said support arc 57 coincides with the radii of the support arcs 55, 56, whereby line contact ensues between the support arcs 55, 56, 57 as regards cross-sectionally circular wire coils 42, 43, or surface contact as regards cross-sectionally rectangular wire coils 42, 43.

The slip-through wire 44 evinces a roof-shaped cross-section at the side facing the top-side coil-turn legs 45, 46 while forming a rest edge 58 extending the length of the slip-through wire 44. On account of this roof-shaped design, triangular free spaces 59, 60 flaring outwards are achieved on both sides of the rest edge 58.

The radius of the rest arcs 55, 56, 57 is large enough that its origin is located approximately in a plane formed by the upper faces of the top-side coil-turn legs 45, 46 and defining a first belt side 61. This belt side 61 serves to support and move for instance a paper web 62. All origins in this case then are located in a neutral plane 63 indicated in dot-dash lines and coinciding approximately with the first belt side 61.

When the wire-link belt 41 is guided around a drying drum while the paper web 62 makes contact with said drum, the first belt side 61 will be bent concavely. Thereupon the wire coils 42, 43 pivot about the particular slip-through wires 44, the support arcs 55, 56 of the end arcs 49, 50 moving in the manner of a bearing on the support arc 57 of the slip-through wire 47. In relation to the radius of the support arcs 55, 56, 57, the pivoting motion then takes place about an axis in the neutral plane 63. This plane 63 practically coinciding with the plane of the paper web 62, no relative motion takes place between paper web 62 and belt side 61.

The same conditions also apply to the reverse case wherein the wire-link belt 41 moves by its lower, second belt side 64 over a guide roller. In this instance the first belt side 61 is bent convexly and the pivot axes also are then located in the neutral plane 63 or in the plane of the paper web 62. In both cases the free spaces 59, 60 assure that the pivoting motions of the wire coils 42, 43 toward each other shall be unhampered within a specified angular range.

In lieu of the roof-shaped profile of the upper side of the slip-through wire 44, this top side also may be made in the shape of a convex arc of circle, indicated in dashed lines in FIG. 3, this arc of circle if desired being of the same radius as that of the support arcs 55 56, 57. In that case the cross-section shall be lenticular or oval and the laterally mutually impacting edges of the arcs may be rounded off.

I claim:

1. A wire-link belt for papermaking machines, the belt minimizing movement of the paper web relative thereto, the belt having a center plane and comprising:

a) a plurality of operably associated wire coils arrayed parallel to the direction of belt advance, each coil has spaced mutually facing first and second end arcs, with each end arc having an upper end and a lower end, and first and second vertically spaced coil-turn legs, with each first leg interconnecting the upper ends of associated ones of said first and second end arcs and with each second leg interconnecting the lower ends of said associated ones of said first and second end arcs, so that said coils provide a first upper surface defined by said first legs for carrying a paper web, an internal open space, and a second lower surface defined by said second legs;

b) the first end arc of each coil is proximate to and cooperates with the second end arc of each immediately laterally adjacent coil so that a slip-through space is thereby defined by aligned portions of the associated open spaces and there are thus a plurality of slip-through spaces disposed in parallel array thereby; and c) a slip-through wire extends through each of said slip-through spaces for interconnecting said coils into a belt, each slip-through wire is sized less than the associated slip-through space and has side edges structured and arranged so that the adjacent end arcs pivotally move relative thereto about a hinge axis offset from the center plane of the belt toward said first surface.

2. The belt of claim 1, wherein:

a) each slip-through wire has an upper edge extending between the associated side edges, and said upper edge extends substantially parallel to said upper surface.

3. The belt of claim 2, wherein:

a) said upper edge conforms to said first legs.

4. The belt of claim 2, wherein:

a) said upper edge from the center thereof has portions tapering downwardly toward said side edges.

5. The belt of claim 1, wherein:

a) each of said slip-through wires has a cross-section of one of a semi-circle, triangle, roof-shape, and oval.

6. The belt of claim 5, wherein:

a) the cross-section of each of said slip-through wires is symmetrical relative to the center thereof.

7. The belt of claim 1, wherein:

a) each of said side edge forms with the associated end arc and second leg a triangular open space.

8. The belt of claim 7, wherein:

a) each triangular space increases in size from the associated end arc along said second leg.

9. The belt of claim 4, wherein:

a) each of said tapered portions forms with the associated end arc and first leg a triangular open space.

10. The belt of claim 1, wherein:

a) said hinge axis is located in a plane lying on said first upper surface.

11. The belt of claim 4, wherein:

a) each of said end arcs conforms to the associated side edge.

12. The belt of claim 3, wherein:

a) said upper edge is a convex arc.

13. The belt of claim 12, wherein:

a) the first and second arcs of each coil have a radius of origin corresponding to the radius of origin of said side edges.

14. The belt of claim 1, further comprising:

a) a cover strip extending laterally through the open space of adjacent coils for controlling air permeability.

15. The belt of claim 1, wherein:

a) each first and second end arc of a coil extends downwardly and outwardly parallel to the direction of belt advance so that said second legs have a length exceeding the length of said first legs.

16. The belt of claim 1, wherein:

a) each first and second end arc of a coil extends arcuately downwardly parallel to the direction of belt advance so that said first legs have a length exceeding the length of said second legs.

17. The belt of claim 1, wherein:

a) each of said slip-through wires is comprised of a polymeric material.

18. A wire-link belt for preventing movement of an overlying paper web in a papermaking machine, the belt having a center plane and comprising:

a) a plurality of coils arranged in a series of parallel rows, each row extending transverse to the direction of belt advance and each row overlapping the immediately precedent row;

b) each coil is unitary and has an internal open space, and the open space of each coil at the opposite ends thereof partially overlaps the open space of the immediately laterally adjacent coil of the immediately precedent and subsequent rows for therewith forming a slip-through space at each end thereof; and c) a slip-through wire extends through each slip-through space for thereby interconnecting said rows into a belt having an upper surface on which a paper web is carried, each slip-through wire structured and arranged so that the associated coils pivot relative thereto about a hinge axis offset from the center plane of the belt toward said upper surface.

19. The belt of claim 18, wherein:

a) each slip-through wire has opposite side edges symmetrical relative to the center thereof.

20. The belt of claim 19, wherein:

a) each slip-through wire has a cross-section of one of a semi-circle, triangle, roof-shape, and oval.

* * * * *